US006911939B2

(12) United States Patent
Carson et al.

(10) Patent No.: US 6,911,939 B2
(45) **Date of Patent: *Jun. 28, 2005**

(54) PATCH AND CAVITY FOR PRODUCING DUAL POLARIZATION STATES WITH CONTROLLED RF BEAMWIDTHS

(75) Inventors: James C. Carson, Sugar Hill, GA (US); Sara Phillips, Norcross, GA (US)

(73) Assignee: EMS Technologies, Inc., Norcross, GA (US)

( * ) Notice: Subject to any disclaimer, the term of this patent is extended or adjusted under 35 U.S.C. 154(b) by 138 days.

This patent is subject to a terminal disclaimer.

(21) Appl. No.: 10/224,760

(22) Filed: Aug. 20, 2002

(65) Prior Publication Data

US 2003/0043076 A1 Mar. 6, 2003

Related U.S. Application Data

(63) Continuation of application No. 09/785,033, filed on Feb. 16, 2001, now Pat. No. 6,462,710.

(51) Int. Cl.[7] ..... H01Q 1/38

(52) U.S. Cl. ..... 343/700 MS; 343/770; 343/818

(58) Field of Search ..... 343/700 MS, 702, 343/767, 770, 846, 853, 818, 848, 872

(56) References Cited

U.S. PATENT DOCUMENTS

| | | | | |
|---|---|---|---|---|
| 4,835,538 A | | 5/1989 | McKenna et al. | 343/700 MS |
| 4,843,400 A | * | 6/1989 | Tsao et al. | 343/700 MS |
| 4,851,855 A | | 7/1989 | Tsukamoto et al. | 343/700 MS |
| 4,903,033 A | | 2/1990 | Tsao et al. | 343/700 MS |
| 5,581,266 A | | 12/1996 | Peng et al. | 343/770 |

(Continued)

FOREIGN PATENT DOCUMENTS

| | | |
|---|---|---|
| EP | 0 892 461 A1 | 1/1999 |
| EP | 0 901 185 A1 | 3/1999 |
| FR | 2724491 A1 | 9/1994 |
| WO | 0 542 595 A1 | 10/1992 |

OTHER PUBLICATIONS

International Search Report for PCT/US 01/05232, Dec. 28, 2001.

International Search Report for PCT/US 01/05237, Oct. 29, 2001.

*Primary Examiner*—Shih-Chao Chen
(74) *Attorney, Agent, or Firm*—King & Spalding LLP

(57) ABSTRACT

An antenna system can generate RF radiation fields having dual simultaneous polarization states and having substantially rotationally symmetric radiation patterns. The antenna system generates RF radiation patterns where the beamwidths of respective RF fields for respective radiating elements are substantially equal and are relatively large despite the compact, physical size of the antenna system. The antenna system can include one or more patch radiators and a non-resonant patch separated from each other by an air dielectric and by relatively small spacer elements. The patch radiators and non-resonant patch can have predefined shapes for increasing polarization discrimination. The lower patch radiators can be mounted to a printed circuit board that can include an RF feed network and a ground plane which defines a plurality of symmetrically, shaped slots. The slots within the ground plane of the printed circuit board can be excited by stubs that are part of the feed network of the printed circuit board. The slots, in turn, can establish a transverse magnetic mode of RF radiation in a cavity which is disposed adjacent to the ground plane of the printed circuit board and a ground plane of the antenna system. The feed network of the printed circuit board can be aligned with portions of the cavity such that the portions of the cavity function as a heat sink for absorbing or receiving thermal energy produced by the feed network.

19 Claims, 9 Drawing Sheets

U.S. PATENT DOCUMENTS 5,596,336 A 1/1997 Liu ..... 343/770
5,828,339 A 10/1998 Patel ..... 343/700 MS
5,874,919 A 2/1999 Rawnick et al. ..... 343/700 MS
5,896,107 A 4/1999 Huynh ..... 343/700 MS
6,008,763 A 12/1999 Nystrom et al. ..... 343/700 MS
6,054,953 A 4/2000 Lindmark ..... 343/701 MS
6,067,053 A 5/2000 Runyon et al. ..... 343/797
6,087,989 A 7/2000 Song et al. ..... 343/700 MS
6,107,965 A 8/2000 Christ ..... 343/700 MS
6,160,522 A 12/2000 Sanford ..... 343/769
6,236,367 B1 5/2001 Du Toit et al. ..... 343/700 MS
6,239,750 B1 5/2001 Snygg ..... 343/700 MS
6,239,762 B1 5/2001 Lier ..... 343/700 MS
6,462,710 B1 * 10/2002 Carson et al. ..... 343/700 MS

* cited by examiner

PATCH AND CAVITY FOR PRODUCING DUAL POLARIZATION STATES WITH CONTROLLED RF BEAMWIDTHS

This application is a continuation of U.S. application Ser. No. 09/785,033, filed Feb. 16, 2001, entitled, "Method and System for Producing Dual Polarization states with Controlled RF Beamwidths", the entire contents of which are hereby incorporated by reference.

TECHNICAL FIELD

The present invention is generally directed to an antenna for communicating electromagnetic signals, and relates more particularly to a planar array antenna having patch radiators exhibiting dual polarization states and producing substantially rotationally symmetric radiation patterns with controlled beamwidths.

BACKGROUND OF THE INVENTION

Diversity techniques at the receiving end of a wireless communication link can improve signal reception without additional interference. One such diversity technique is generating dual simultaneous polarization states. The term "dual simultaneous polarization states" typically means that an antenna has at least two different radiators, where each radiator simultaneously generates or receives RF energy according to a separate and unique polarization relative to an opposing active radiator. Therefore, unlike circular polarization which employs phasing between respective radiators, dual simultaneous polarization states requires respective radiators to be fed in phase. Those skilled in the art recognize that an antenna's polarization is defined to be that of its electric field, in the direction where field strength is maximum.

Dual polarization states can increase performance of a base station antenna that is designed to communicate with portable communications units having mobile antennas. The effectiveness of dual polarization for a base station antenna relies on the premise that transmit polarization of a typically linearly polarized mobile or portable communications unit will not always be aligned with a vertical linear polarization for the antenna at a base station site nor will it necessarily be in a linearly polarized state. Further, depolarization, which is the conversion of power from a reference polarization into the cross polarization, can occur along the multi-path propagation between the mobile user and a base station.

In order to compensate for the effects of depolarization, dual polarization can be employed at a base station antenna in order to communicate with mobile or portable communication units. However, dual polarization or polarization diversity typically requires a significant amount of hardware that can be rather complex to manufacture. Further, conventional dual polarized antennas typically cannot provide symmetrical radiation patterns where respective electric field (E) and magnetic field (H) plane beamwidths are substantially equal. Additionally, conventional antenna systems usually cannot provide for a wide range of magnetic field (H) plane beamwidths from a compact antenna system. In other words, the conventional art typically requires costly and bulky hardware in order to provide for a wide range of operational beamwidths, where beamwidth is measured from the half-power points (−3 dB to −3 dB) of a respective RF beam.

Another draw back of the conventional art relates to the manufacturing of an antenna system and the potential for passive intermodulation (PIM) that can result because of the material used in conventional manufacturing techniques. More specifically, with conventional antenna systems, dissimilar materials, ferrous materials, metal-to-metal contacts, and deformed or soldered junctions are used in order to assemble a respective antenna system. Such manufacturing techniques can make an antenna system more susceptible to PIM and therefore, performance of a conventional antenna system can be substantially reduced.

A further problem in the conventional art is the ability to effectively control the beamwidth of the resulting radiation patterns of a dual polarized antenna system. The conventional art typically does not provide for any simple techniques for controlling beamwidth of a dual polarized antenna system.

Unrelated to the problems discussed above, antenna designers are often forced to design antennas in a backward fashion. For example, because of the increasing public concern over aesthetics and the "environment", antenna designers are typically required to build an antenna in accordance with a radome that has been approved by the general public, land owners, government organizations, or neighborhood associations that will reside in close proximity to the antenna. Radomes are typically enclosures that protect antennas from environmental conditions such as rain, sleet, snow, dirt, wind, etc. Requiring antenna designers to build an antenna to fit within a radome as opposed to designing or sizing a radome after an antenna is constructed creates many problems for antenna designers. Stated differently, the antenna designer must build an antenna with enhanced functionality within spatial limits that define an antenna volume within a radome. Such a requirement is counterproductive to antenna design since antenna designers recognize that the size of antennas are typically a function of their operating frequency. Therefore, antenna designers need to develop high performance antennas that must fit within volumes that cut against the ability to size antenna structures relative to their operating frequency.

Accordingly, there is a need in the art for a substantially compact antenna system that can fit within a predefined volume and that can exhibit dual polarization states while also providing for adjustable beamwidths. There is a further need in the art for a compact dual polarization antenna system that can provide radiation fields having substantially rotationally symmetric radiation patterns. There is also a need in the art for a compact antenna system that can generate RF radiation patterns where the beamwidth of respective RF fields for respective radiating elements are substantially equal and are relatively large despite the compact, physical size of the antenna system. There is a further need in the art for a compact antenna system exhibiting dual polarization states that can also provide for adjustable beamwidths in a fairly simple manner. Further, there is another need in the art for a compact antenna system that can be manufactured with ease and that can utilize manufacturing techniques which substantially reduce passive intermodulation. There is an additional need in the art for a substantially compact antenna system that can handle the power characteristics of conventional antenna systems without degrading the performance of the antenna system.

SUMMARY OF THE INVENTION

The present invention solves the aforementioned problems with an antenna system that can generate RF radiation fields having dual simultaneous polarization states and having substantially rotationally symmetric radiation patterns.

The term "rotationally symmetric" typically means that radiation patterns of respective radiators having different polarizations are substantially symmetrical and substantially equal. In other words, the present invention can generate RF radiation patterns where the beamwidths of respective RF fields for respective radiating elements are substantially equal and are relatively large despite the compact, physical size of the antenna system. For example, the present invention can produce radiation patterns where each RF polarization produced by an individual radiating element is substantially equal to a corresponding orthogonal RF polarization produced by another individual radiating element. For example, the beamwidths produced by each radiating element can be adjusted from widths of approximately sixty-five (65) to ninety (90) degrees, where beamwidth is measured from the half-power points (−3 dB to −3 db) of a respective RF beam. Other beamwidths are not beyond the scope of the present invention.

This enhanced functionality can be achieved with a compact antenna system, where the antenna system (without a radome) can typically have a height of approximately less than one seventh (1/7) of a wavelength and a width that is less than or equal to six-tenths (0.6) of a wavelength. With a radome, the antenna system can have a height of approximately one-fifth (1/5) of a wavelength. The antenna system can comprise one or more patch radiators and a non-resonant patch separated from each other by an air dielectric and by relatively small spacer elements. The patch radiators and non-resonant patch can have predefined shapes for increasing polarization discrimination.

In one exemplary embodiment, the patch radiators and non-resonant patch can have a substantially circular shape. The circular shape can enable the patch radiators and non-resonant patch to maintain orthogonality of two polarizations over a given angular region to ensure that any two RF signals are highly de-correlated. The circular shape of the patch radiators can also keep E (electric field) and H (magnetic field) plane beamwidths of individual radiating elements substantially equal and symmetrical.

The beamwidth of RF energy generated by one or more lower resonant patch radiators can be controlled by an upper non-resonant patch. The upper non-resonant patch is typically spaced at a non-resonant distance relative to the lower patch radiators to prevent resonance while controlling the beamwidth of the resultant RF radiation patterns.

The lower patch radiators can be mounted to a printed circuit board that can comprise an RF feed network and a ground plane which defines a plurality of symmetrically, shaped slots. In one exemplary embodiment, the slots can comprise a double-H shape that has an electrical path length that is less than or equal to a half wavelength.

The slots within the ground plane of the printed circuit board can be excited by stubs that are part of the feed network of the printed circuit board. The slots, in turn, can establish a transverse magnetic mode of RF radiation in a cavity which is disposed adjacent to the ground plane of the printed circuit board and a ground plane of the antenna system.

The slots can be aligned along a diagonal of a cavity while the cavity can be concentrically aligned with geometric centers of the patch radiators. The feed network of the printed circuit board can be aligned with portions of the cavity such that the portions of the cavity function as a heat sink for absorbing or receiving thermal energy produced by the feed network. Because of this efficient heat transfer function, the printed circuit board can comprise a relatively thin dielectric material that is typically inexpensive.

The cavity disposed between the printed circuit board and the ground plane of the antenna system can function electrically as a closed boundary when mechanically, the cavity has open corners. The open corner design facilitates ease in manufacturing the cavity. The open corners of the cavity can also have dimensions that permit resonance while substantially reducing Passive Intermodulation (PIM).

PIM can be further reduced by planar fasteners used to attach respective flanges and a planar center of a respective cavity to the ground plane of the printed circuit board and the ground plane of the antenna system. The planar fasteners can comprise a dielectric adhesive. In addition to the dielectric adhesive, the present invention can also employ other types of fasteners that reduce the use of dissimilar materials, ferrous materials, metal to metal contacts, deformed or soldered junctions and other similar materials in order to reduce PIM.

For example, the patch radiators and non-resonant patch can be spaced apart by plastic fasteners that permanently "snap" into place. Such fasteners not only reduce PIM, but such fasteners substantially reduce labor and material costs associated with the manufacturing of the antenna system.

While providing a product that can be manufactured efficiently, the present invention also provides an efficient RF antenna system. The RF energy produced by the cavity, slots, and stubs can then be coupled to one or more lower patch radiators. The one or more lower patch radiators can then resonate and propagate RF energy with a wide range of H-plane beamwidths that can extend between approximately sixty-five (65) and ninety (90) degrees.

DETAILED DESCRIPTION OF THE PRESENT INVENTION

The antenna of the present invention can solve the aforementioned problems and is useful for wireless communications applications, such as personal communication services (PCS) and cellular mobile radio telephone (CMR) service. The antenna of the present invention can use polarization diversity to mitigate the deleterious effects of fading and cancellation resulting from a complex propagation environment. The antenna system can include a patch radiator, a printed circuit board disposed adjacent to the patch radiator, and plurality of slots disposed within a ground plane of the printed circuit board. The antenna further includes a cavity disposed adjacent to the ground plane of the printed circuit board and a second ground plane disposed adjacent to the cavity. The antenna system radiates RF energy having dual simultaneous polarization states and having substantially rotationally symmetric radiation patterns.

Figure 1:
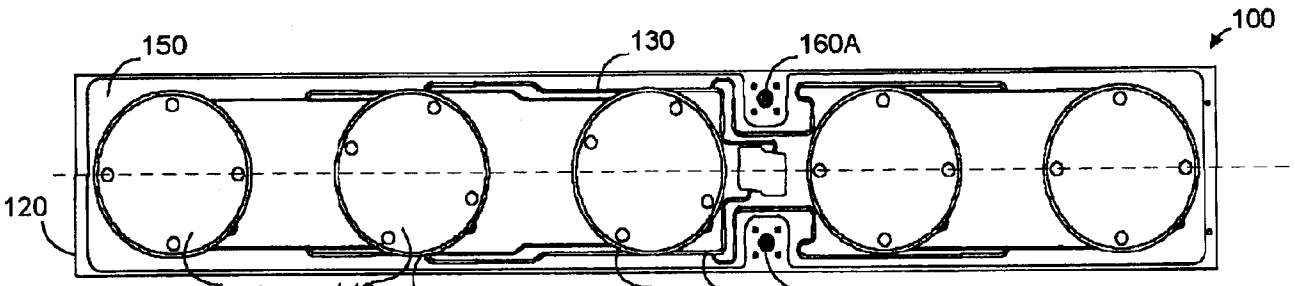
FIG. 1 is an illustration showing an elevational view of the construction of an exemplary embodiment of the present invention.

Turning now to the drawings, in which like reference numerals refer to like elements, FIG. 1 is an illustration showing an elevational view of one exemplary embodiment of the present invention. Referring now to FIG. 1, an antenna system 100 is shown for communicating electromagnetic signals with the high frequency spectrums associated with conventional wireless communication systems. An antenna system 100 can be implemented as a planar array of radiating elements 110, known as wave generators or radiators, wherein the array is positioned along a vertical plane of the antenna as viewed normal to the antenna site.

The antenna system 100, which can transmit and receive electromagnetic signals, includes radiating elements 110, a ground plane 120, and a feed network 130. The antenna system 100 further includes beam shaping elements 140, a printed circuit board 150 and ports 160A and 160B.

Figure 2:
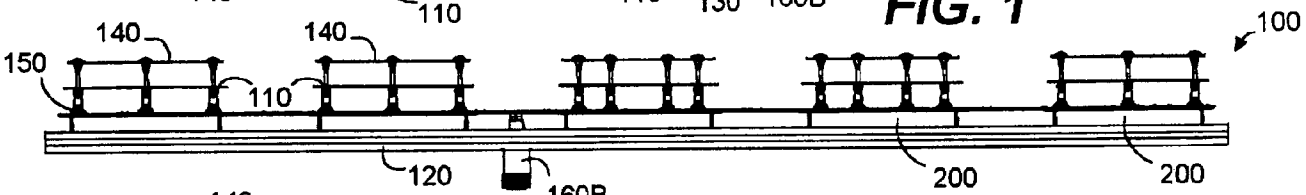
FIG. 2 is an illustration showing a side view of the exemplary embodiment shown in FIG. 1.

Referring now to FIG. 2 which illustrates the side view of the antenna system 100 of FIG. 1, the spatial relationship between beam forming elements 140 and the radiating elements 110 are more clearly shown. On a side of the printed circuit board 150 opposite to the radiating elements 110 and beam forming elements 140 are a plurality of cavities 200 which will be discussed in further detail below. The ports 160A and 160B can comprise coaxial cable type connectors.

Figure 3:
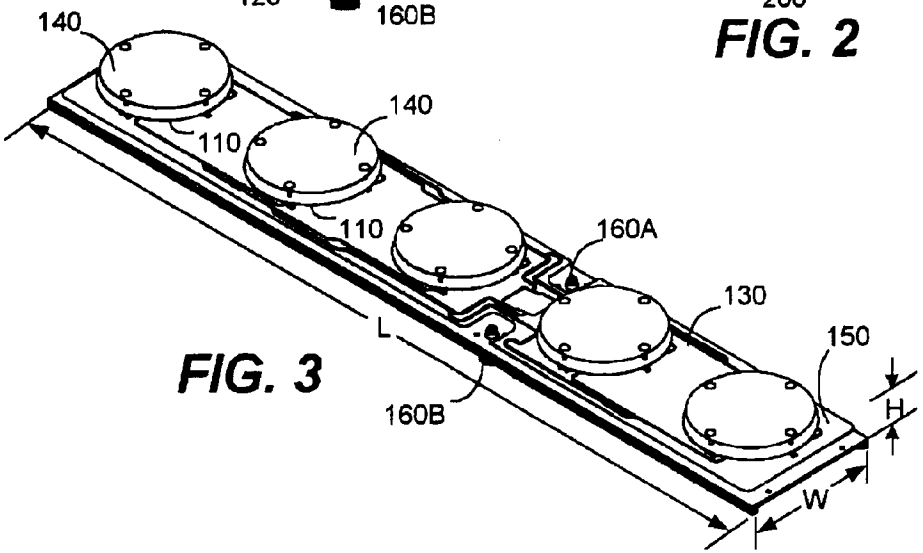
FIG. 3 is an illustration showing an isometric view of the exemplary embodiment shown in FIGS. 1 and 2.

FIG. 3 further illustrates an isometric view of the antenna system 100 which can comprise one or more radiating elements 110 and beam forming elements 140. The antenna system 100 as illustrated in FIG. 3 is very compact yet high performance product that can be placed or positioned in a very narrow or small volume such as a radome. For example, in one exemplary embodiment, the length L can be approximately 48 inches while the width W can be approximately 8 inches. The height H of the antenna system 100 (including a radome) can be 2.75 inches. In this exemplary embodiment the operating frequency range is approximately from 806 MHz to 896 MHz. In terms of wavelength, this means that the width W can be less than or equal to a six-tenths (0.6) of a wavelength. Similarly, the height H can be less than or equal to one-seventh (1/7) of a wavelength without a radome. With a radome, the antenna system can have a height of approximately one-fifth (1/5) of a wavelength. The length L can be varied depending upon the number of radiating elements 110 desired to be in the antenna system 100.

Figure 4:
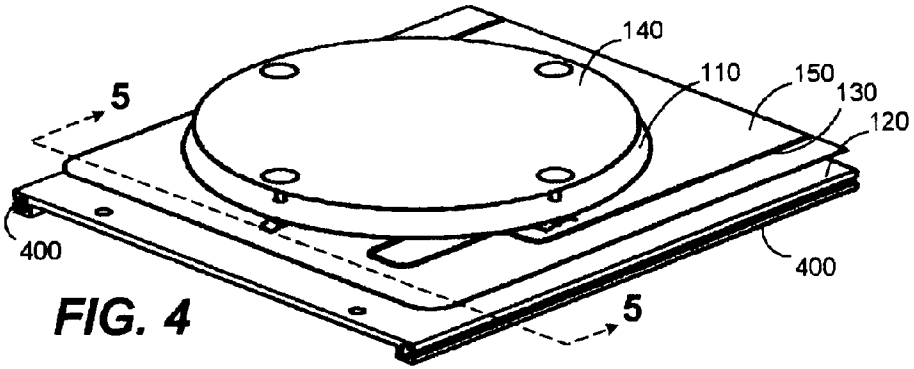
FIG. 4 is an illustration showing an isometric view of some core components of an exemplary embodiment of the present invention.

Referring now to FIG. 4, this figure illustrates some of the core components of antenna system 100 in more enlarged detail. FIG. 4 illustrates how ground plane 120 further includes groves 400 that can support a radome (as will be discussed in further detail below). As mentioned above, the present invention can include one or more radiating elements 110 while, typically (in an exemplary embodiment), only one beam forming element 140 is employed.

Figure 5:
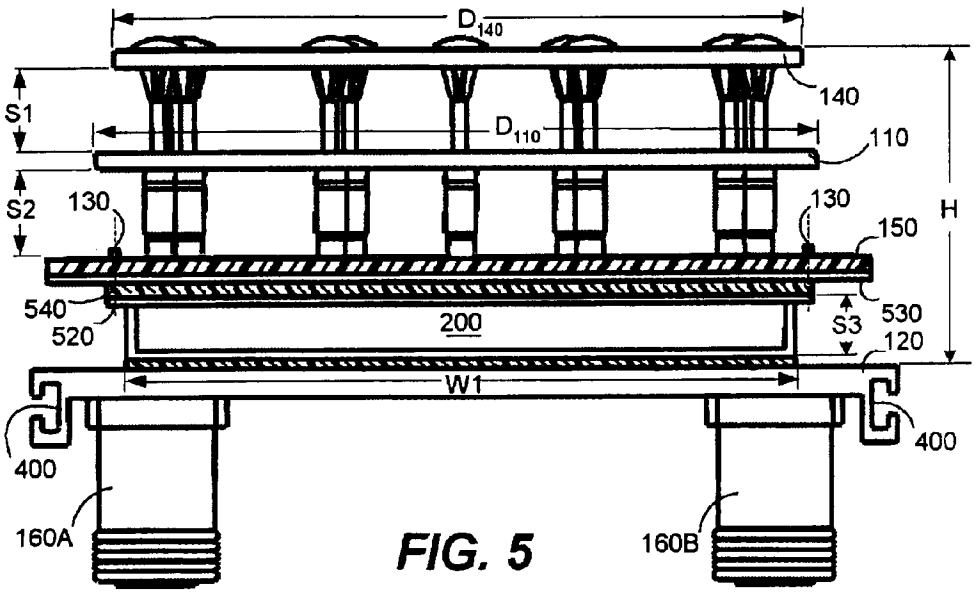
FIG. 5 is a cross-sectional view of the exemplary embodiment illustrated in FIG. 4 taken along the cut line 5—5.

Referring now to FIG. 5, this figure illustrates a cross-section of the antenna system 100 illustrated in FIG. 4. This particular cross-section is taken along the cut line 5—5 as illustrated in FIG. 4. FIG. 5 provides further details of the mechanical elements which form the inventive antenna system 100. The sizes of materials illustrated in FIG. 5 are not shown to scale. In other words, some of the materials have been exaggerated in size so that these materials can be seen easily. A more accurate depiction of the relative sizes of materials will be illustrated below with respect to FIG. 11.

The beam forming element 140 is spaced from the radiating element 110 by a spacing S1. Spacing S1 is typically a nonresonant dimension. That is, the parameter S1 relative sizes is typically neither a resonant dimension nor a dimension that promotes resonance of the beam forming element 140. The beamwidth of the present invention can be controlled by adjusting the spacing parameter S1 and by adjusting the diameter $D_{140}$ of the beam forming element 140. The diameter $D_{140}$ is also typically a non-resonant dimension.

By increasing the spacing parameter S1 (the space between the beam forming element 140 and the radiating element 110) the beamwidth of the electromagnetic radiation emitted by the antenna system 100 can be increased. Conversely, beamwidth can be decreased by lowering the S1 parameter (decreasing the spacing between the upper and lower patches) and by increasing the diameter $D_{140}$ of the beam forming element 140.

The radiating antenna element 110 can be spaced from the printed circuit board 150 by a spacing parameter S2 which is typically a resonant value. In other words, the parameter S2 is one that typically promotes resonance of the radiating patch element 110. In terms of wavelength, the parameter S2 is typically between 0.03 to 0.04 wavelengths (or 0.42 to 0.55 inches at the exemplary operating frequency range). The diameter $D_{110}$ of the radiating element is typically between 0.40 to 0.47 wavelengths. However, the present invention is not limited to these values. Other resonant dimensions are not beyond the scope of the present invention.

The beam forming element 140 is typically held in place relative to the radiating element 110 by spacer elements/fasteners 500 which can comprise dielectric stand-offs. The radiating element 110 is similarly spaced from the printed circuit board 150 by a plurality of spacers/fasteners 500. The spacers/fasteners 500 are typically designed to permanently "snap" into place in order to eliminate or reduce the use of soldering points of the present invention. This, in turn, also substantially reduces work in the manufacturing process of the Antenna System 100. Further, by using such spacers/fasteners passive intermodulation (PIM) can also be substantially reduced or eliminated. However, the present invention is not limited to "snap" type fasteners. Other fasteners or dielectric supports that can reduce PIM are not beyond the scope of the present invention. For example, slim or narrow blocks of dielectric foams could be used to support the radiating elements 110 and beam forming elements 140. Also, the fasteners 500 do not need to permanently fix these elements. That is, releasable fasteners 500 could be employed and not depart from the scope and spirit of the present invention.

As illustrated in FIGS. 4 and 5, the beam forming element 140 and the radiating element 110 typically comprise patch elements. The beam forming element 140 and radiating element 110 are typically made from conductive materials such as aluminum. Specifically, both elements can be made from aluminum 5052. Similarly, the cavity 200 can also be constructed from aluminum. However, other conductive materials are not beyond the scope of the present invention for the resonating structures. Further, the radiating element 110 and beam forming element 140 can also be constructed with combinations of materials such as dielectric materials coated with a metal. Those skilled in the art will appreciate the various ways in which radiating elements can be constructed without departing from the scope and spirit of the present invention.

In one preferred exemplary embodiment, both the beam forming element 140 and Radiating Element 110 are substantially circular in shape. The circular shape of the patches 140, 110 in combination with the apertures or slots 700 (as will be discussed below) and resonating cavity 200 increase polarization discrimination by the antenna system 100. The circular shape of the Patches 140, 110 can also contribute to maintaining the orthogonality of two polarizations over a given angular region to ensure that any two RF signals are highly de-correlated.

The circular shape of the beam forming element 140 and radiating element 110 can also maximize the performance of the polarization by keeping the electric (E) and magnetic (H) plane beamwidth substantially equal. The circular shape of the beam forming element 140 and radiating element 110 also permits the antenna system 100 to keep radiation patterns symmetrical. However, the present invention is not limited to circularly shaped elements. Other shapes include, but are not limited to, square, rectangular, and other similar shapes that maximize the performance of dual polarization by keeping electric (E) and magnetic (H) plane beamwidth substantially equal.

FIG. 5 illustrates further details of the antenna system 100 that are not shown in the previous figures. For example, portions of the feed network 130 are substantially aligned over portions of the cavity 200. By aligning portions of the feed network 130 over portions of the cavity 200, such as flanges 520 (as will be discussed in further detail below) the present invention can dissipate heat energy formed within the feed network 130 more efficiently and rapidly. The flanges 520 can serve as a heat sink to portions of the feed network 130.

By using portions of the resonating 200 cavity as a heat sink, a relatively thin printed circuit board 150 can be used. The cavity 200 can be fastened to the printed circuit board 150 (and more specifically, the ground plane 530 of the printed circuit board 150) by using a planar fastener 540 such as a dielectric adhesive. This planar fastener 540 can then reduce the thermal resistance between the feed network 130 and the flange 520.

The cavity 200 can also be attached to the ground plane 120 with a similar planar fastener 540 such as a dielectric adhesive discussed above. Using such fasteners not only reduces the thermal resistance between the feed network 130 and the cavity, it also substantially reduces passive intermodulation (PIM). With portions of the cavity 200 functioning as a heat sink for the feed network 130 disposed upon a printed circuit board 150, a relatively thin substrate of material can be used as the printed circuit board 150. The cavity 200 is attached to the ground plane 530 of the printed circuit board 150 with a planar fastener 540. Similarly, the cavity 200 is attached to the radome supporting ground plane 120 by a planar fastener 540.

The cavity 200 typically propagates a transverse magnetic ($TM_{01}$) mode of RF energy for the two polarizations supported by the antenna system 100. Since cavity 200 resonates, the height or spacing S3 of the cavity has a resonant dimension of 0.027 wavelengths (or a dimension of 0.375 inches at the exemplary operating frequency). The width W1 of the resonant cavity 200 can have a resonant dimension of 0.433 wavelengths. However, the present invention is not limited to these values. Other resonant dimensions are not beyond the scope of the present invention. While propagating a transverse magnetic mode of RF energy, cavity 200 can also substantially increase the front to back ratio of the antenna system 100. The cavity 200 is excited by two or more slots 700 as will be discussed in further detail below.

Figure 6:
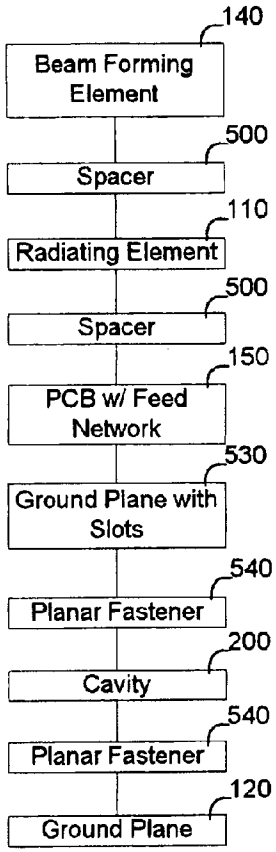
FIG. 6 is a block diagram illustrating some of the core components of the exemplary embodiment illustrated in FIG. 5.

FIG. 6 is a functional block diagram illustrating the various components which make up the compact antenna system 100. This figure highlights one exemplary and preferred arrangement of the components of the antenna system 100. Of the components illustrated in FIG. 6, there are a select few which may be considered the core components of the Antenna System 100 that provide the enhanced functionality in such a compact antenna volume. The core components may be considered as the beam forming element 140, the radiating element 110, the printed circuit board 150, the ground plane 530 with slots 700, and the cavity 200.

Figure 7A:
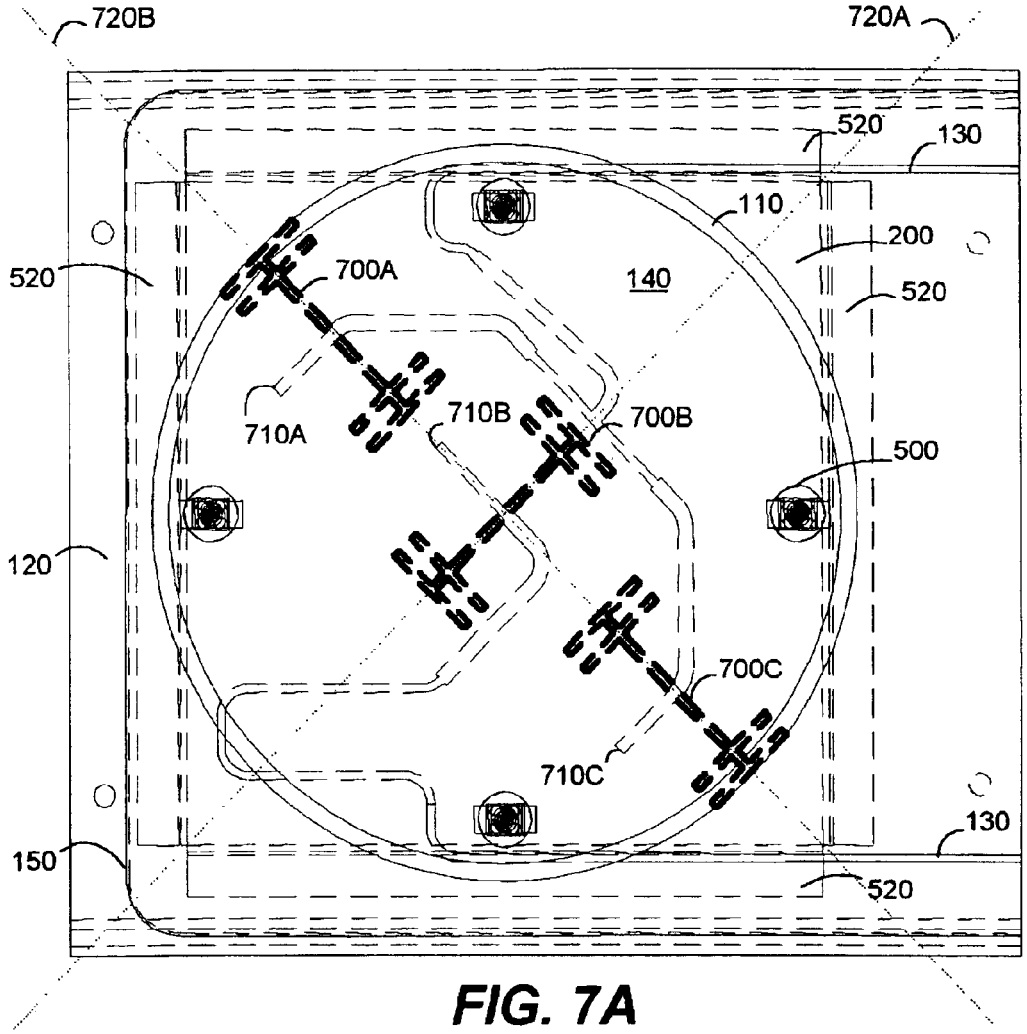
FIG. 7A is an illustration showing an elevational view of the exemplary embodiment illustrated in FIG. 4 while also showing hidden views of the slots which feed the cavity and one or more radiating elements.

Referring now to FIG. 7A, further details of the slots 700A-C disposed within the ground plane 530 are shown. The slots 700A–C are excited by a corresponding number of stubs 710A–C that are positioned within the feed network 130 disposed on one side of the Printed Circuit Board 150. The slots 700 are typically symmetrically-shaped in order to reduce cross-polarization between respective slot. The slots 700A, 710C are oriented perpendicular to the central slot 700B. Such an orientation of the slots 700 sets up or establishes dual polarization states.

Further, it is desirable to orient the slots 700 along geometric diagonals 720A and 720B in order to maintain slant forty-five polarizations over an intended region of operation while improving port-to-port isolation. Placing the slots 700 along the geometric diagonals 720A and 720B can also reduce cross-polarization between the two dual polarization states established by the antenna system 100. The slots 700 are also designed to be narrow and symmetrical in order to increase port-to-port isolation. The spacing and orientation of the slots 700 relative to the radiating element 110 can optimize the desired transverse magnetic $TM_{01}$ mode of operation within the resonating cavity 200 for the two polarizations. In this embodiment, two orthogonal $TM_{01}$ modes are generated in the cavity 200.

Optimization can be accomplished by placing these slots 700 along the geometric diagonals 720A, 720B and using the center of the cavity 200 as the origin for the radiating patches 110. That is, the geometric centers of the radiating element 110, beam forming element 140, and cavity 200 can be substantially aligned. However, the present invention is not limited to this number and combination of slots. For example, instead of three separate slots the present invention could employ a cross-shaped slot (not shown) to feed the antenna patches. But with this cross-shaped design, two soldering connections would be required for a respective crossed-slot. And soldering connections could degrade antenna performance somewhat because of the resulting PIM.

Figure 7B:
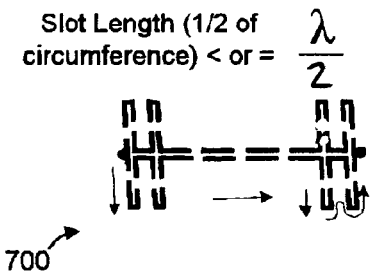
FIG. 7B is an illustration showing an exemplary slot according to the present invention.

Referring now to FIG. 7B, the slots 700 can also have a predefined shape. For example, in one exemplary embodiment, each Slot 700 have the substantially double-h shape. However, the present invention is not limited to this shape. Other shapes include, but are not limited to, shapes that have an electrical length that is less than or equal to one-half the wavelength. The electrical length of a slot is typically found by measuring the one-half of the perimeter of the opening, starting at one far end of the slot to another far end. An electrical length of less than or equal to one-half of a wavelength facilitates efficient coupling of RF energy to the cavity 200 and patch radiating element 110. The orientation and placement of the slot 700 should be designed for equal beamwidths of the polarizations so that the polarization factor can be maintained at a value of 45.

Figure 8:
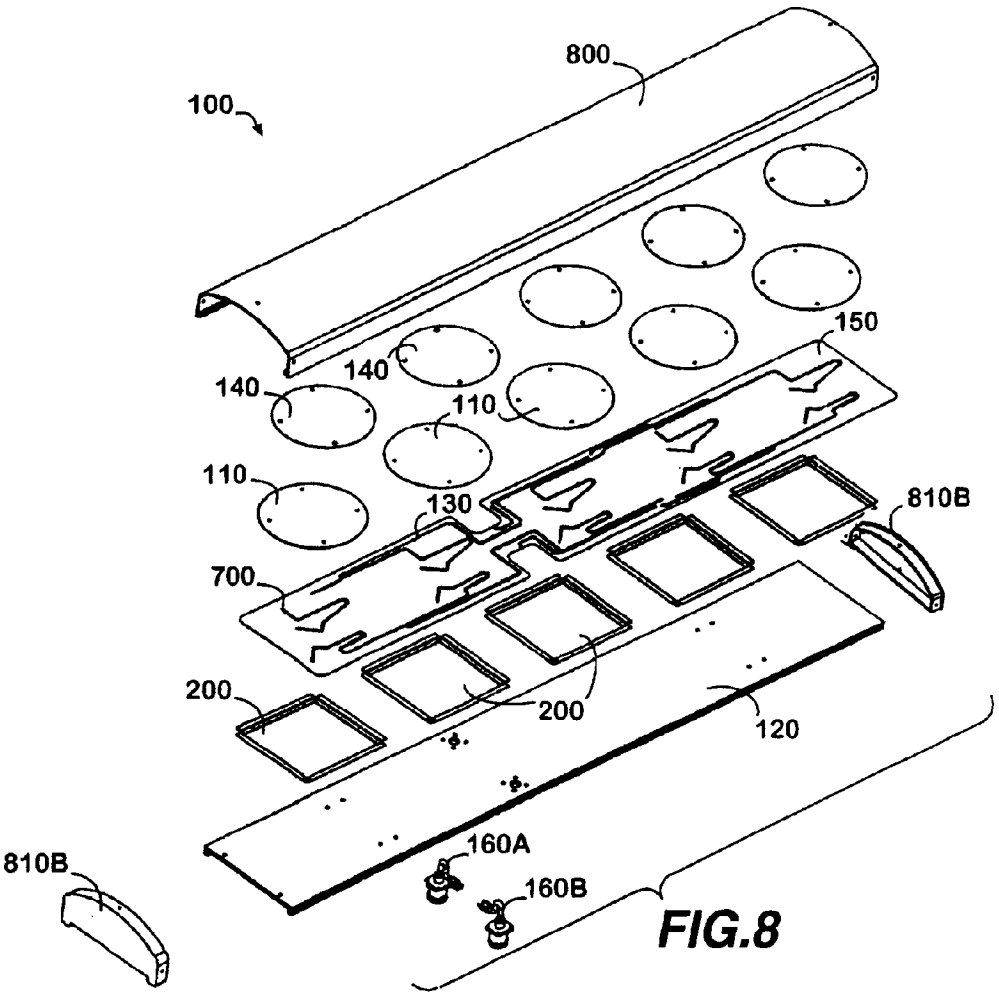
FIG. 8 is an illustration showing an exploded view of an exemplary embodiment of the present invention.

Referring now to FIG. 8, this figure illustrates an exploded view of the components of the antenna system 100. A protective radome 800 comprising a PVC material can be used to cover the antenna system 100. A radome 800 preferably comprises a PVC material manufactured in the desired form by an extrusion process. The radome 800 is attached to the grooves 400 formed in the ground plane 120. A pair of end caps 810A and 810B are positioned along a minor dimension at an end of the ground plane 120 and cover the remaining openings formed at the end of the combination of the ground plane 120 and the radome 800. Encapsulation of the antenna system 100 within the sealed enclosure formed by the ground plane 120, a radome 800, and the end caps 810A-B protects the antenna system 100 from environmental elements, such as direct sunlight, water, dust, dirt and moisture.

The printed circuit board 150 is a relatively thin sheet of dielectric material and can be one of many low-loss dielectric materials used for the purpose of radio circuitry. In one preferred and exemplary embodiment, the material used can have a relative dielectric constant values of $d_k$=3.38 (and $\epsilon_r$=2.7—when substrate is used as microstrip). In the preferred exemplary environment, teflon-based substrate materials are typically not used in order reduce cost. However, TEFLON-based and other dielectric materials are not beyond the scope of the present invention. Disposed adjacent to the printed circuit board 150 is the ground plane 530 which is illustrated with further detail in FIG. 9.

Figure 9:
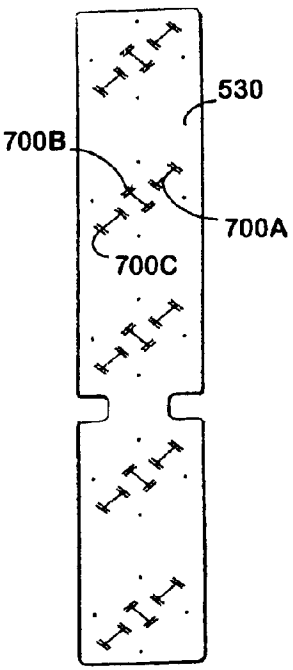
FIG. 9 is an illustration showing a bottom or rear view of a ground plane of the printed circuit board comprising the feed network as illustrated in FIG. 8.

Referring now to FIG. 9, the ground plane 530 contains the slots 700 used to excite the cavity 200. These slots 700 can be preferably etched out of the ground plane 530 by photolithography techniques.

Figure 10A:
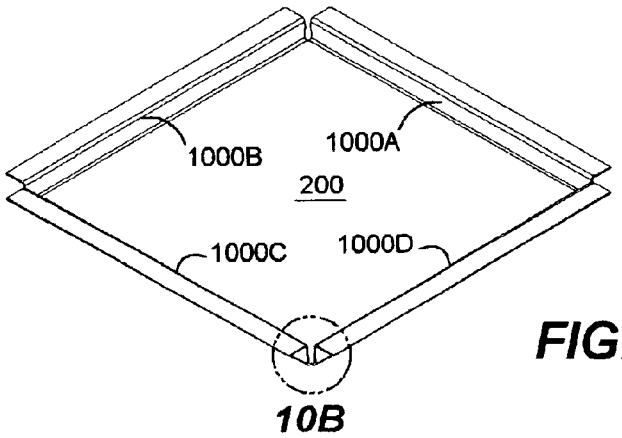
FIG. 10A is an illustration showing an isometric view of an exemplary resonant cavity for the present invention.

Referring now to FIG. 10A, this figure further illustrates the details of the resonant cavity 200. The cavity 200 is preferably made from aluminum and has a design which promotes accurate repeatability while substantially reducing passive intermodulation (PIM). However, other conductive materials are not beyond the scope of the present invention. The cavity 200 comprises walls 1000A–D that are spaced apart from each other by a predetermined distance d (See FIG. 10B). This predetermined distance d between the walls 1000 at the corners allows for reasonable tolerances in manufacturing, but is typically small enough such that the cavity 200 electrically operates as a closed boundary for RF energy propagating within the cavity 200. In other words, the cavity 200 can function electrically as a closed boundary when mechanically the cavity has open corners. The open corners of the cavity typically have dimensions that permit resonance while substantially reducing passive intermodulation (PIM). The open corners of the cavity also function as drainage holes for any condensation that may form within a respective cavity 200.

Figure 10B:
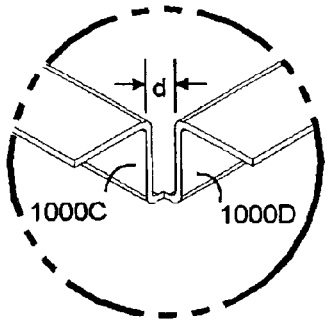
FIG. 10B is an illustration showing an enlarged area focused on an exemplary corner structure of the resonant cavity shown in FIG. 10A.

Referring now to FIG. 10B, a distance d exists between cavity walls 1000C and 1000D. As mentioned above, distance d is sized such that the cavity can resonate while at the same time it can substantially reduce passive intermodulation since there is no metal-to-metal contact between the respective walls 1000C and 1000D. PIM is further reduced by the present invention because dissimilar materials, ferrous materials, metal-to-metal contacts, and deformed or soldered junctions are preferably not used in order to substantially reduce or eliminate this physical phenomenon.

For example, in addition to the open corners of the cavity 200, the present invention employs (as discussed above) planar fasteners 540 to attach the Flanges 520 of the cavity 200 to the ground plane 530 of the printed circuit board 120. Meanwhile, the base of the cavity 200 can be attached to the radome-supporting ground plane 120 by another dielectric planar fastener. Similarly, the radiating element 110 is supported by non-soldered spacers/fasteners 500, and also supports additional spacers/fasteners 500 to support the beam forming element 140.

Figure 11:
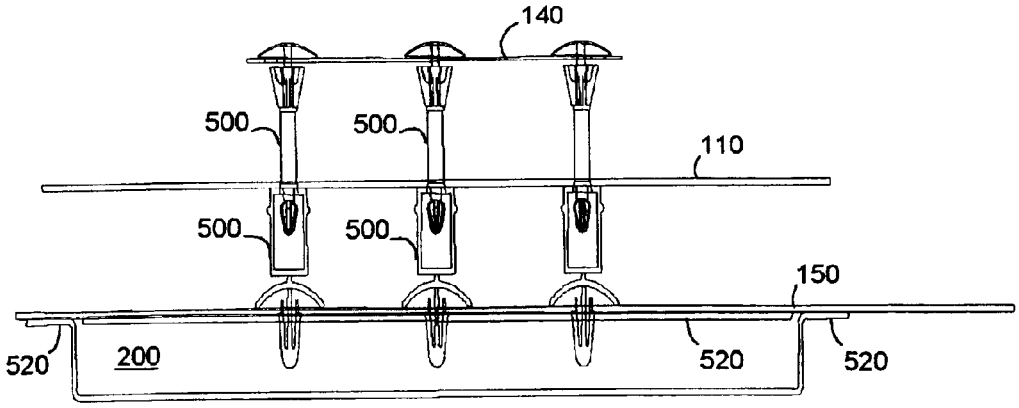
FIG. 11 is an illustration showing a typical mounting arrangement for an antenna provided by an exemplary embodiment of the present invention.

Referring now to FIG. 11, this figure further illustrates a more accurate depiction of the relative sizes (thickness) of materials which make up the antenna system 100. Further mechanical details of the spacers/fasteners 500 are shown. As mentioned previously, these spacers/fasteners are preferably constructed from dielectric materials to reduce (PIM) while also permitting ease of manufacturing of the antenna system 100. That is, the spacers/fasteners 500 can be permanently "snapped" into place without the use of any deformed or soldered junctions.

Figure 12A:
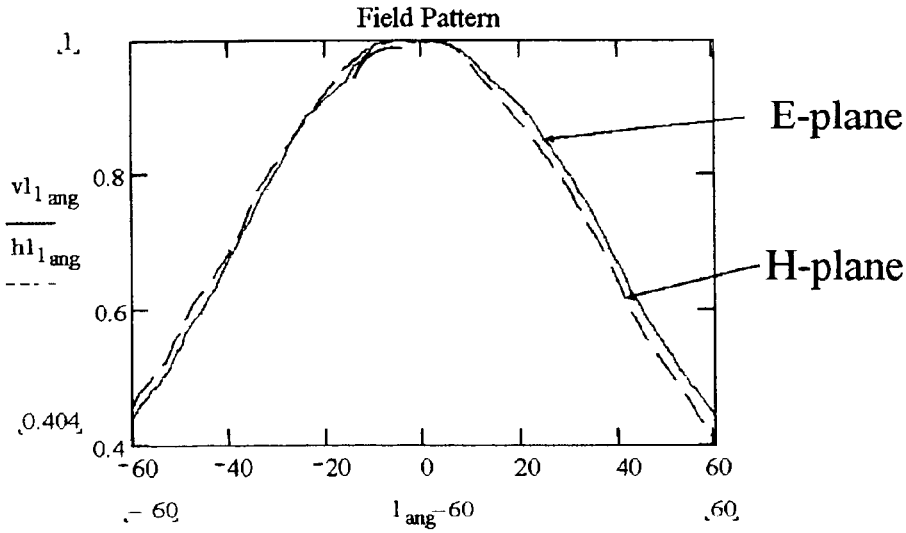
FIG. 12A is a graph illustrating the beamwidths of (E) and (H) plane radiation patterns according to one exemplary embodiment of the present invention.

Referring now to FIG. 12A, this figure illustrates a linear plot of antenna gain versus the angular position of a radiation pattern for a ninety (90) degree beamwidth embodiment of antenna system 100. That is, this graph illustrates the gain for an antenna system 100 designed to have 90 degrees of coverage between respective three (3) dB or half power points in a radiation pattern. This graph demonstrates that the (E) and (H) beamwidth of an independent polarization are substantially equal. Substantially equal (E) and (H) plane beamwidths will maintain the orthogonality of the two polarization states over a given angular region to insure that two received signals are highly decorrelated. Two polarization states are not shown in FIG. 12A, only one polarization state with substantially equal E and H planes is illustrated. For this particular exemplary embodiment, the angular region has been designed for 90 degrees.

To obtain a 90 degree beamwidth the diameter and spacing S1 of the gain forming element 140 can be adjusted.

As noted above, to increase the (E) and (H) plane beamwidth, the spacing between the beam forming element 140 and the radiating element 110 is increased, while the diameter of the Beam Forming Element 140 can be reduced. Conversely, to decrease the (E) and (H) plane beamwidth, the separation S1 between the beam forming element 140 and the radiating element 110 can be decreased while the diameter $D_{140}$ of the beam forming element can be increased. With the present invention, it is possible to maintain about five degrees of difference between 3 dB beamwidths of respective (E) and (H) plane radiation patterns of a particular polarization.

Figure 12B:
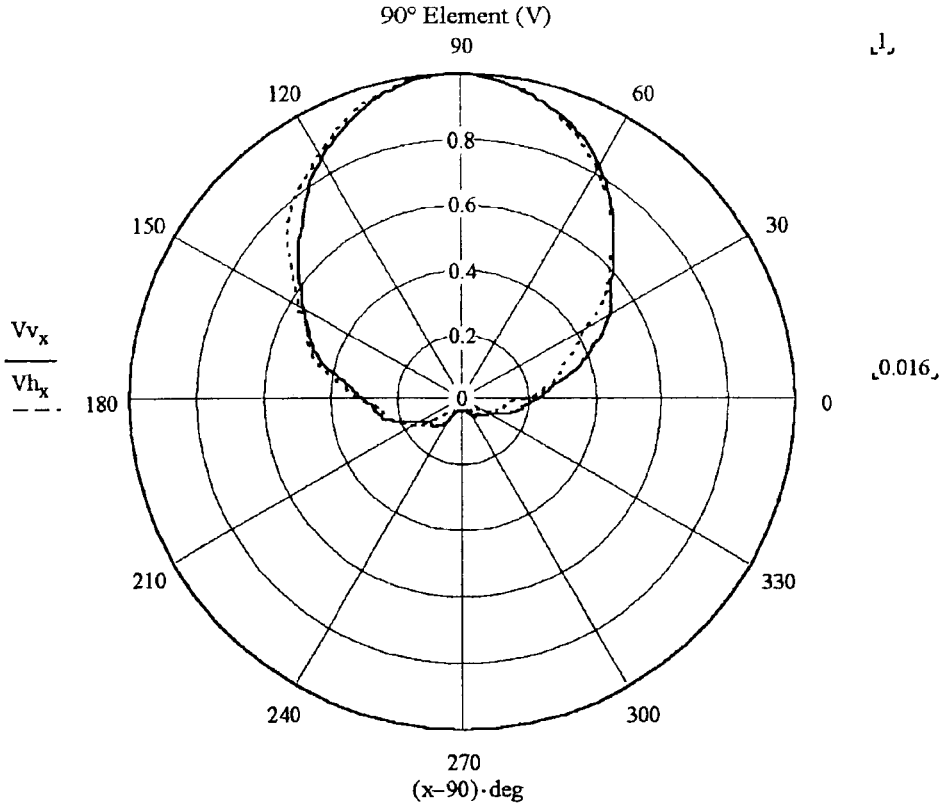
FIG. 12B is a radiation pattern in terms of voltage illustrating the beamwidths of (E) and (H) planes according to the exemplary embodiment illustrated in FIG. 12A.

Referring to FIG. 12B, this figure is a radiation pattern in polar coordinates and in terms of voltage illustrating the ninety (90) degree beamwidth embodiment discussed in FIG. 12A. The pattern illustrates the (E) plane radiation pattern with a solid line and the (H) plane pattern with a dashed or dotted line.

Figure 13A:
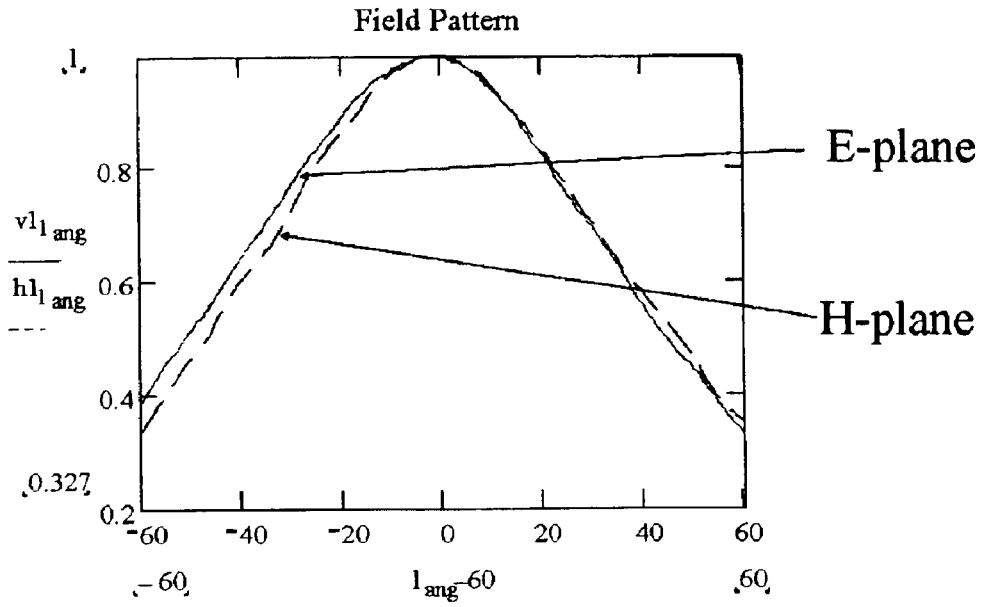
FIG. 13A is a graph illustrating beamwidths of another (E) and (H) plane radiation pattern according to an alternative exemplary embodiment of the present invention.

Referring now to FIG. 13A, this figure illustrates a plot of antenna gain versus the angular position of a radiation pattern for a sixty-five (65) degree beamwidth embodiment of antenna system 100. That is, this graph illustrates the gain for an antenna system 100 designed to have 65 degrees of coverage between respective three (3) dB or half power points in a radiation pattern. This graph also demonstrates that the (E) and (H) beamwidth of an independent polarization are substantially equal. Substantially equal (E) and (H) plane beamwidths will maintain the orthogonality of the two polarization states over a given angular region to insure that two received signals are highly decorrelated. Two polarization states are not shown in FIG. 13A, only one polarization state with substantially equal E and H planes is illustrated.

Figure 13B:
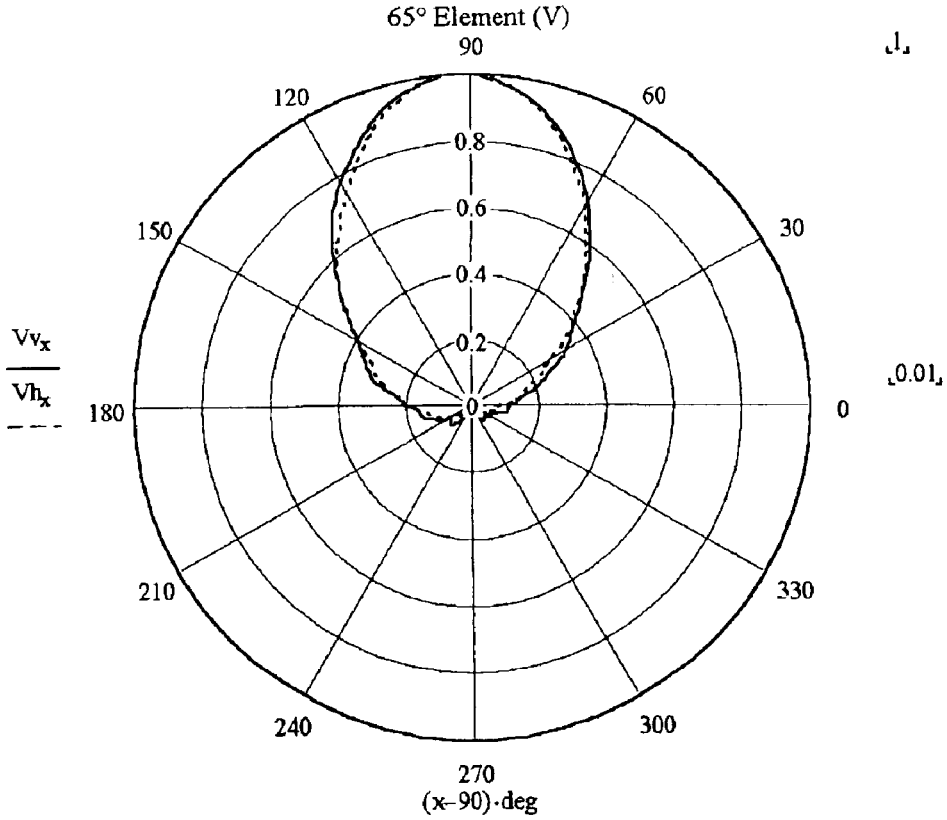
FIG. 13B is a radiation pattern in terms of voltage illustrating the beamwidths of (E) and (H) planes according to the alternative exemplary embodiment illustrated in FIG. 13A.

Referring to FIG. 13B, this figure is a radiation pattern in polar coordinates and in terms of voltage illustrating the sixty-five (65) degree beamwidth embodiment discussed in FIG. 13A. The pattern illustrates the (E) plane radiation pattern with a solid line and the (H) plane pattern with a dashed or dotted line.

Figure 14:
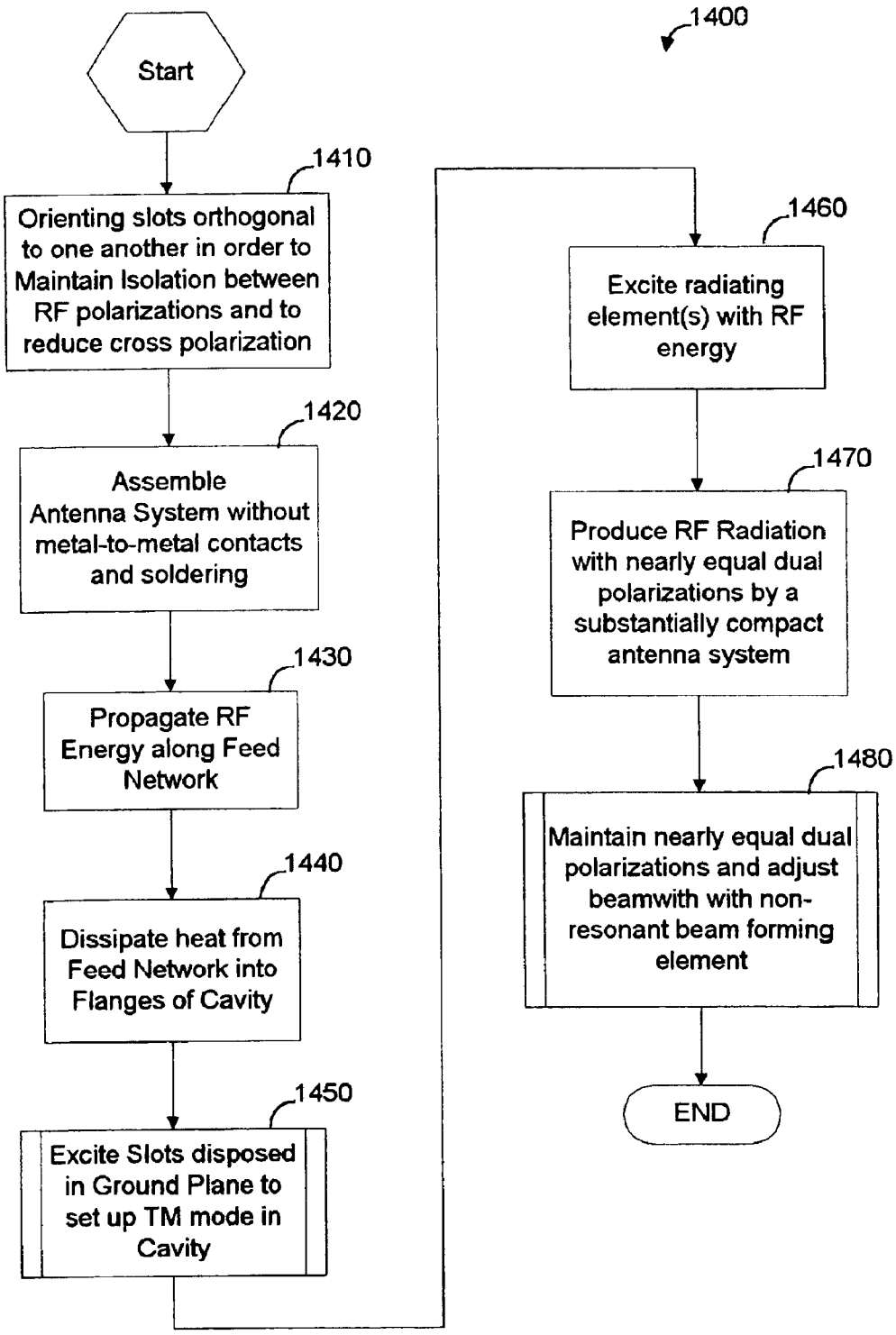
FIG. 14 is an exemplary logical flow diagram describing a method for producing dual simultaneous polarization states and a rotationally symmetric radiation pattern where the electric field and magnetic field beamwidths of individual radiating elements are substantially equal and symmetrical.

FIG. 14 illustrates a logical flow diagram 1400 for a method of generating RF radiation fields having dual, simultaneous polarization states and having substantially rotationally symmetric radiation patterns. The logical flow diagram 1400 highlights some key functions of the antenna system 100.

Step 1410 is the first step of the inventive process 1400 in which the slot 700 disposed within the ground plane 530 are oriented orthogonal to one another. By orienting the slots orthogonal to one another in step 1410, isolation between separate RF polarizations can be maintained while cross-polarization can be reduced.

Next, in step 1420, the antenna system 100 is assembled without metal-to-metal contacts and soldering. More specifically, in this step, the antenna system 100 can be manufactured in a way to substantially reduce passive intermodulation (PIM). Dissimilar materials, ferrous materials, metal-to-metal contacts, and deformed or soldered junctions are typically not employed or are limited in the antenna system 100 in order to substantially reduce or eliminate PIM. One way in which PIM is substantially reduced or eliminated is the use of dielectric planer fasteners 540 in order to connect portions of the cavity 200 to the slotted ground plane 530 and the ground plane 120. Another way in which PIM is reduced or substantially eliminated is by employing open corners in the cavity 200 where respective walls, such as walls 1000C and 1000D of FIG. 10B, are spaced apart by the predetermined distance d.

Next, in step 1430 RF energy is propagated along the feed network 130 of the printed circuit board 150. In step 1440, heat is dissipated from the feed network 130 into flanges 520 of the cavity 200.

In routine 1450, the slots disposed in ground plane 530 set up or establish a transverse magnetic (TM) mode of RF energy in the cavity 200. Further details of routine 1450 will be discussed in further detail below with respect to FIG. 15.

In step 1460, the radiating elements such as the lower patch radiators 110 are excited with RF energy emitted from the slot 700 or the stubs 710 or both. Next, in step 1470, RF radiation is produced with nearly equal dual polarizations by the substantially compact antenna system 100. In routine 1480, the nearly equal dual polarizations are maintained and beamwidths can be adjusted with the beam shaping element 140. Further details of routine 1480 will be discussed below with respect to FIG. 16.

Figure 15:
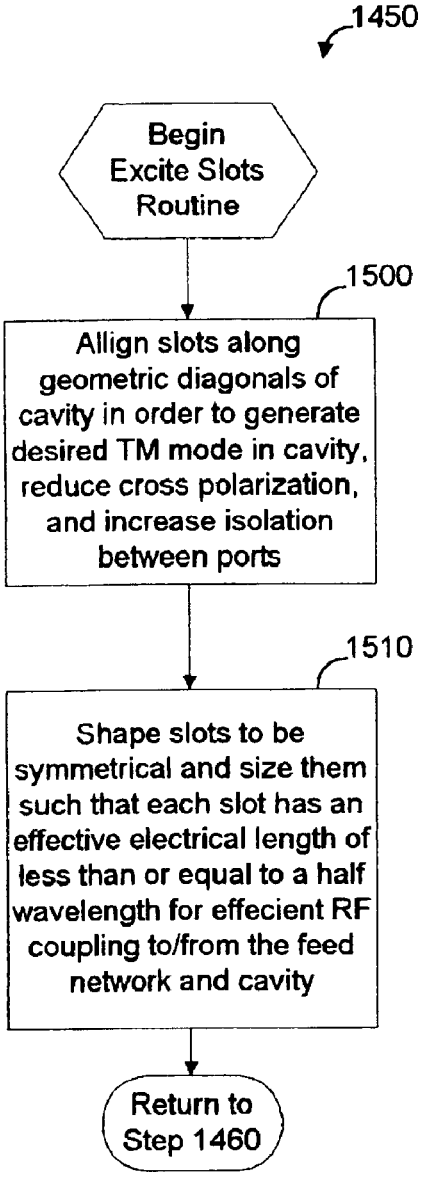
FIG. 15 is a logical flow diagram illustrating an exemplary slot excitation routine of FIG. 14.

FIG. 15 illustrates an exemplary slot excitation routine 1450 of FIG. 14. Routine 1450 begins with step 1500. In step 1500, the slots 700 are aligned along geometric diagonals 720 of the cavity 200, as illustrated in FIG. 7. This alignment of the slots 700 produces a desired transverse magnetic mode of RF energy in the cavity 200 while substantially reducing cross-polarization and increasing isolation between respective ports 160A and 160B.

Next, in step 1510, the slots 700 are shaped to be symmetrical and sized such that each slot 700 has an effective electrical length of less than or equal to a half wavelength for efficient RF coupling to or from the feed network 130 and the cavity 200 or radiating patch 110. The routine then returns to step 1460 of FIG. 14.

Figure 16:
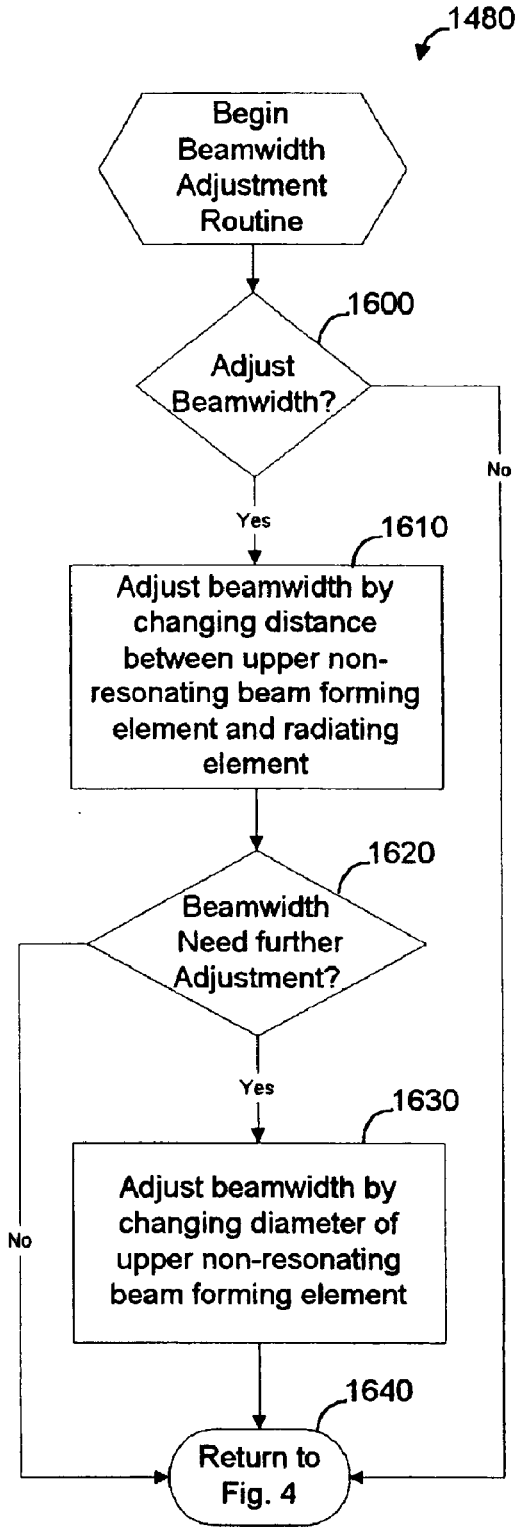
FIG. 16 is another logical flow diagram illustrating an exemplary beamwidth adjustment routine of FIG. 14.

FIG. 16 illustrates an exemplary beam width adjustment routine 1480 of FIG. 14. Routine 1480 begins with step 1600, in which it is determined whether the beamwidth of the antenna system 100 needs adjustment. If the inquiry to decision step 1600 is positive, then the "yes" branch is followed to step 1610. In step 1610, the beamwidth of the antenna system 100 can be adjusted by changing the spacing between the beam forming element 140 and the radiating element 110. Typically, the spacing is of a non-resonant dimension since in one exemplary feature of the present invention, the beam forming element 140 does not resonate RF energy. If the inquiry to decision step 1600 is negative, then the "no" branch is followed to step 1640.

In step 1620, it is determined whether further beamwidth adjustment is needed. If the inquiry to decision step 1620 is positive, then the "yes" branch is followed to step 1630, in which the beamwidth of the antenna system 100 can be adjusted by changing the diameter of the beam forming element 140. It is noted that the present invention is not limited to the sequence or chronology of steps illustrated in these logic flow diagrams. Therefore, one of ordinary skill in the art recognizes that the beamwidth of antenna system 100 can be first adjusted by changing the diameter of the beam forming element 140 instead of first changing the spacing between the beam forming element 140 and radiating element 110. Further, those skilled in the art will also recognize that adjustments to beamwidth can also be made by changing both the spacing between the beam forming element 140 and the radiating element 110, as well as changing the size of the beam forming element 140. In step 1640, the routine returns to FIG. 14.

The present invention provides an aperture or slot coupled patch elements that generate dual slant 45 degree polarization in addition to substantially rotationally symmetric radiation patterns. The present invention generates RF radiation patterns where the beamwidths of respective RF fields for respective radiating elements are substantially equal and are relatively large despite the compact, physical size of the antenna system. For example, the present invention produces radiation patterns where each RF polarization produced by an individual radiating element is substantially equal to a corresponding orthogonal RF polarization produced by another individual radiating element.

The present invention provides a compact antenna system that has a height (without radome) of less than one-seventh (1/7) of a wavelength and a width that is less than or equal to one-half of a wavelength. With a radome, the height can be one-fifth (1/5) of a wavelength. While being compact, the present invention is power efficient. The present invention incorporates an efficient heat transfer design such that a feed network transfers its heat to a resonating cavity used to set up desired transverse magnetic modes of RF energy. The efficient heat transfer permits the present invention to utilize relatively thin dielectric materials for the printed circuit board supporting the feed network.

The present invention employs circular metallic radiating elements for the purpose of obtaining circular and symmetric (E) and (H) plane 3 dB beamwidths having simultaneous slant 45 dual polarization states. The spacing S2 of the radiating element 110 relative to the printed circuit board 150 and the diameter of the radiating element 110 is used to improve the impedance beamwidths of the antenna system 100. The beam forming element 140 is used to vary the 3 dB beamwidths to obtain desired values by adjusting its diameter and varying its spacing S1 between the radiating element 110 and the beam forming element 140. The present invention further incorporates a low PIM design approach by utilizing capacitive coupling of all potential metal-to-metal junctions through employing non-conductive planar fasteners and open corners for the resonant cavity 200. The low PIM design approach also yields efficient and low cost manufacturing methods. For example, the planar fasteners 540 eliminate any need for soldering the resonant cavity 200 to the ground plane 530. The use of dielectric spacers 500 further eliminates any need for costly dielectric spacer sheets while also reducing assembly time.

The present invention also employs two orthogonal forty-five degree slanted slots that are non-collocated along perpendicular lines of symmetry at forty-five degrees from an array axis. Such slots eliminate a need for a feed line to cross over to provide improved cross-polarization and port-to-port isolation.

Alternative embodiments will become apparent to those skilled in the art to which the present invention pertains without departing from its spirit and scope. Thus, although this invention has been described in exemplary form with a certain degree of particularity, it should be understood that the present disclosure has been made only by way of example and that numerous changes in the details of construction and the combination and arrangement of parts may be resorted to without departing from the spirit and scope of the invention. Accordingly, the scope of the present invention is defined by the appended claims rather than the foregoing description.

What is claimed is:

1. An antenna system comprising:

a patch antenna;

a feed network;

a ground plane;

a first slot disposed within the ground plane and electrically coupled to the feed network;

a second slot disposed within the ground plane and electrically coupled to the feed network, wherein each slot is oriented at ninety degrees relative to each other; and an enclosed volume disposed adjacent to the ground plane, the slots exciting the enclosed volume such that said patch antenna radiates RF energy in a controlled manner.

2. The antenna system of claim 1, wherein the patch antenna is a first patch, the antenna system further comprising a second patch spaced from said first patch antenna.

3. The antenna system of claim 2, wherein said second patch is spaced a non-resonant distance from the first patch such that said second patch controls a beamwidth of RF energy produced by the first patch antenna.

4. The antenna system of claim 1, wherein the enclosed volume propagates a transverse magnetic mode of the RF energy.

5. The antenna system of claim 1 wherein the slot has a substantially symmetrical shape.

6. An antenna system comprising:

a patch antenna;

a feed network;

a ground plane;

a slot disposed within the ground plane and electrically coupled to the feed network, the slot having a double-H shape; and an enclosed volume disposed adjacent to the ground plane, the slot exciting the enclosed volume such that said patch antenna radiates RF energy in a controlled manner.

7. The antenna system of claim 6, wherein the patch antenna is a first patch, the antenna system further comprising a second patch spaced from said first patch antenna.

8. The antenna system of claim 7, wherein said second patch is spaced a non-resonant distance from the first patch such that said second patch controls a beamwidth of RF energy produced by the first patch antenna.

9. The antenna system of claim 6, wherein the enclosed volume propagates a transverse magnetic mode of the RF energy.

10. An antenna system comprising:

a patch antenna;

a feed network;

a ground plane;

a slot disposed within the ground plane and electrically coupled to the feed network; and an enclosed volume disposed adjacent to the ground plane, the slot exciting the enclosed volume such that said patch antenna radiates RF energy in a controlled manner, wherein the enclosed volume comprises four walls.

11. The antenna system of claim 10, wherein the slot has a substantially symmetrical shape.

12. The antenna system of claim 10, wherein the patch antenna is a first patch, the antenna system further comprising a second patch spaced from said first patch antenna.

13. An antenna system for a compact volume comprising:

a non-resonant patch;

a patch antenna;

a feed network;

a ground plane; and a cavity disposed adjacent to the ground plane, the feed network exciting the cavity such that said patch antenna radiates RF energy in a controlled manner.

14. The antenna system of claim 13, wherein the non-resonant patch is spaced from the patch antenna by a non-resonant distance.

15. The antenna system of claim 13, wherein the non-resonant patch is spaced from the patch antenna by a non-resonant distance falling within a range comprising 0.03 to 0.04 wavelengths at an operating frequency.

16. The antenna system of claim 13, wherein the non-resonant patch is spaced from the patch antenna by a dielectric spacer.

17. The antenna system of claim 13, wherein the non-resonant patch is spaced from the patch antenna by a dielectric spacer comprising a fastener.

18. The antenna system of claim 13, further comprising a slot disposed within the ground plane and electrically coupled to the feed network and exciting the cavity.

19. The antenna system of claim 13, wherein the cavity has a substantially rectangular shape.

* * * * *